US008217586B2

(12) United States Patent
Xu et al.

(10) Patent No.: US 8,217,586 B2
(45) Date of Patent: Jul. 10, 2012

(54) APPARATUS AND METHOD FOR DIMMING A BACKLIGHT WITH PSEUDO-RANDOM PHASE DELAY

(75) Inventors: Jingwei Xu, Shanghai (CN); Xianwei Zeng, Shanghai (CN); Xianghao Meng, Shanghai (CN)

(73) Assignee: Texas Instruments Incorporated, Dallas, TX (US)

( * ) Notice: Subject to any disclaimer, the term of this patent is extended or adjusted under 35 U.S.C. 154(b) by 323 days.

(21) Appl. No.: 12/692,230

(22) Filed: Jan. 22, 2010

(65) Prior Publication Data

US 2010/0188012 A1 Jul. 29, 2010

(51) Int. Cl.
*H05B 41/16* (2006.01)
*H05B 41/24* (2006.01)

(52) U.S. Cl. ..... 315/287; 315/246

(58) Field of Classification Search ..... 315/291, 315/307, 308, 224, 246, 287
See application file for complete search history.

(56) References Cited

U.S. PATENT DOCUMENTS

| | | | | |
|---|---|---|---|---|
| 7,132,818 | B2 * | 11/2006 | Matsuura | 323/222 |
| 7,279,995 | B2 | 10/2007 | Kernahan et al. | |
| 7,474,064 | B2 * | 1/2009 | Lai et al. | 315/307 |
| 2005/0083269 | A1 | 4/2005 | Lin et al. | |

FOREIGN PATENT DOCUMENTS

| | | |
|---|---|---|
| EP | 0875994 | 11/1998 |
| EP | 1568044 | 4/2008 |
| JP | 05-276030 | 10/1993 |
| JP | 2006269930 | 10/2006 |
| JP | 2008198430 | 8/2008 |

OTHER PUBLICATIONS

PCT Search Report dated Nov. 5, 2009.

* cited by examiner

*Primary Examiner* — Douglas W Owens
*Assistant Examiner* — Minh D A
(74) *Attorney, Agent, or Firm* — John J. Patti; Wade J. Brady, III; Frederick J. Telecky, Jr.

(57) ABSTRACT

A method for generating an actuation signal for a light source is provided. A random phase delay for each period of an input signal is generated, where each period is a predetermined length. Each phase delay is added to a predetermined actuation period to generate a sum. The sum is compared to the predetermined length. At least one turn-on and at least one turn-off for each period of the input signal is calculated from the comparison of the sum to the predetermined length, and the actuation signal having each turn-on and each turn-off is generated.

25 Claims, 1 Drawing Sheet

APPARATUS AND METHOD FOR DIMMING A BACKLIGHT WITH PSEUDO-RANDOM PHASE DELAY

CROSS-RELATED APPLICATIONS

This application claims priority from PCT Application No. PCT/CN2009/000114, filed Jan. 24, 2009, which is hereby incorporated by reference for all purposes.

TECHNICAL FIELD

The invention relates generally to a circuit for powering a light emitting diode (LED) and, more particularly, to a circuit that employs a phase delay for dimming a backlight.

BACKGROUND

Referring to FIG. 1 of the drawings, a timing diagram depicting the operation of a convention pulse width modulator (PWM) is shown. In this timing diagram, LED current versus time is shown. Specifically, the duty cycle is 50% with a period of T. Conventional PWMs operating in a similar manner to that shown in FIG. 1, however, have a "shimming" effect of bright and dark banks on a liquid crystal display (LCD), which is caused at least in part by dimming of a backlight LED and by parasitic effects associated with the LCD. Some examples of conventional PWMs are as follows: European Patent No. 1568044 and U.S. Pat. No. 7,279,995.

SUMMARY

An embodiment of the present invention, accordingly, provides a method for generating an actuation signal for a light source. The method comprises the steps of generating a phase delay for each period of an input signal, wherein each period is a predetermined length; adding each phase delay to a predetermined actuation period to generate a sum; comparing the sum to the predetermined length; calculating at least one turn-on and at least one turn-off for each period of the input signal from the comparison of the sum to the predetermined length; and generating the actuation signal having each turn-on and each turn-off.

In accordance with an embodiment of the present invention, the step of comparing further comprises the step of determining whether the sum is greater than, less than, or approximately equal to the predetermined length.

In accordance with an embodiment of the present invention, the step of calculating further comprises the step of determining the turn-on for each period having its sum being less than the predetermined length to be at its corresponding phase delay after the beginning of its corresponding period.

In accordance with an embodiment of the present invention, the step of calculating further comprises the step of determining the turn-off for each period having its sum being less than the predetermined length to be at its corresponding phase delay plus the actuation period after the beginning of its corresponding period.

In accordance with an embodiment of the present invention, the step of calculating further comprises the step of determining the turn-on for each period having its sum being greater than the predetermined length to be at the beginning of the period and to be at its corresponding phase delay after the beginning of its corresponding period.

In accordance with an embodiment of the present invention, the step of calculating further comprises the step of determining the turn-off for each period having its sum being greater than the predetermined length to be at its corresponding phase delay plus the actuation period after the beginning of the previous period.

In accordance with an embodiment of the present invention, the step of calculating further comprises the step of determining the turn-on for each period having its sum being approximately equal to the predetermined length to be at its corresponding phase delay after the beginning of its corresponding period.

In accordance with an embodiment of the present invention, the step of calculating further comprises the step of the turn-off for each period having its sum being approximately equal to the predetermined length to be at the beginning of its corresponding period.

In accordance with an embodiment of the present invention, an apparatus for generating an actuation signal for a light source is provided. The apparatus comprises means for generating a phase delay for each period of an input signal, wherein each period is a predetermined length; means for adding each phase delay to a predetermined actuation period to generate a sum; means for comparing the sum to the predetermined length; means for calculating at least one turn-on and at least one turn-off for each period of the input signal from the comparison of the sum to the predetermined length; and means for generating the actuation signal having each turn-on and each turn-off.

In accordance with an embodiment of the present invention, the means for comparing further comprises means for determining whether the sum is greater than, less than, or approximately equal to the predetermined length.

In accordance with an embodiment of the present invention, the means for calculating further comprises means for determining the turn-on for each period having its sum being less than the predetermined length to be at its corresponding phase delay after the beginning of its corresponding period.

In accordance with an embodiment of the present invention, the means for calculating further comprises means for determining the turn-off for each period having its sum being less than the predetermined length to be at its corresponding phase delay plus the actuation period after the beginning of its corresponding period.

In accordance with an embodiment of the present invention, the means for calculating further comprises means for determining the turn-on for each period having its sum being greater than the predetermined length to be at the beginning of the period and to be at its corresponding phase delay after the beginning of its corresponding period.

In accordance with an embodiment of the present invention, the means for calculating further comprises means for determining the turn-off for each period having its sum being greater than the predetermined length to be at its corresponding phase delay plus the actuation period after the beginning of the previous period.

In accordance with an embodiment of the present invention, the means for calculating further comprises means for determining the turn-on for each period having its sum being approximately equal to the predetermined length to be at its corresponding phase delay after the beginning of its corresponding period.

In accordance with an embodiment of the present invention, the means for calculating further comprises means for determining the turn-off for each period having its sum being approximately equal to the predetermined length to be at the beginning of its corresponding period.

In accordance with an embodiment of the present invention, an apparatus for generating an actuation signal for a light source is provided. The apparatus comprises a generator that receives an input signal having a plurality of periods with a predetermined length and that generates a phase delay for each period of the input signal; and a state machine that receives each phase delay and a predetermined actuation period, adds each phase delay to the predetermined actuation period to generate a sum, compares the sum to the predetermined length, calculates an on-time and an off-time for each period of the input signal from the comparison of the sum to the predetermined length, and generates the actuation signal having each on-time and each off-time.

In accordance with an embodiment of the present invention, the apparatus further comprises a sync register that outputs the actuation signal to the state machine.

In accordance with an embodiment of the present invention, the apparatus further comprises a phase lock loop that generates a pulse width modulated (PWM) signal from the input signal and that outputs the PWM signal to the state machine.

In accordance with an embodiment of the present invention, the state machine generates the actuation signal having the turn-on for each period having its sum being less than the predetermined length to be at its corresponding phase delay after the beginning of its corresponding period.

In accordance with an embodiment of the present invention, the state machine generates the actuation signal having the turn-off for each period having its sum being less than the predetermined length to be at its corresponding phase delay plus the actuation period after the beginning of its corresponding period.

In accordance with an embodiment of the present invention, the state machine generates the actuation signal having the turn-on for each period having its sum being greater than the predetermined length to be at the beginning of the period and to be at its corresponding phase delay after the beginning of its corresponding period.

In accordance with an embodiment of the present invention, the state machine generates the actuation signal having the turn-off for each period having its sum being greater than the predetermined length to be at its corresponding phase delay plus the actuation period after the beginning of the previous period.

In accordance with an embodiment of the present invention, the state machine generates the actuation signal having the turn-on for each period having its sum being approximately equal to the predetermined length to be at its corresponding phase delay after the beginning of its corresponding period.

In accordance with an embodiment of the present invention, the state machine generates the actuation signal having the turn-off for each period having its sum being approximately equal to the predetermined length to be at the beginning of its corresponding period.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
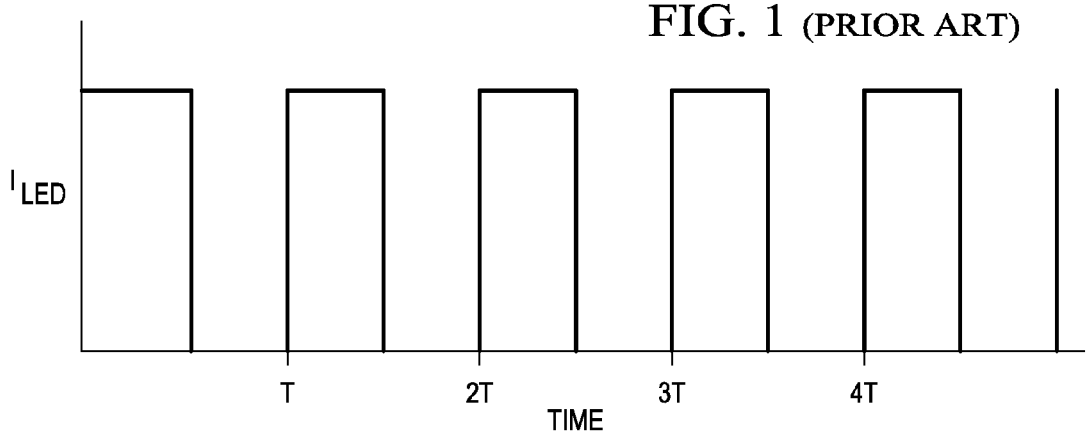
FIG. 1 (PRIOR ART)
FIG. 1 is a timing diagram depicting the operation of a conventional pulse width modulator (PWM)

Refer now to the drawings wherein depicted elements are, for the sake of clarity, not necessarily shown to scale and wherein like or similar elements are designated by the same reference numeral through the several views.

Figure 2:
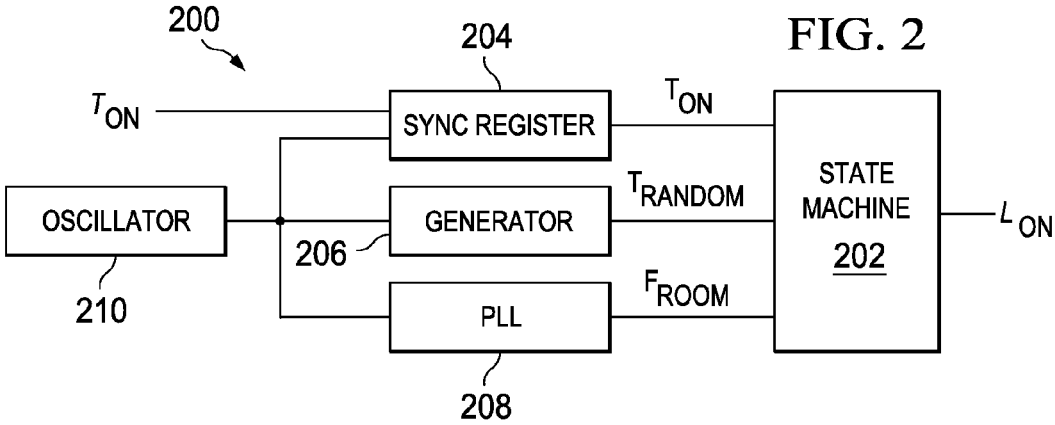
FIG. 2 is an actuation circuit in accordance with an embodiment of the present invention.

Referring to FIG. 2 of the drawings, the reference numeral 200 generally designates an actuation circuit in accordance with an embodiment of the present invention. Circuit 200 generally comprises a state machine 202, synchronization or sync registers 204, a generator 206, and a phase lock loop (PLL) 208.

In operation, each of the sync registers 204, generator 206, and PLL 208 provide certain signals to the state machine 202. Preferably, the sync register 204 receives an n-bit (such as an 8-bit), an actuation period $T_{ON}$, and output the actuation period $T_{ON}$ in synchronization with an input signal or clock signal that has a period T from oscillator 210. The generator 206 (which is preferably a pseudo-random number generator) receives the input signal from oscillator and generates a phase delay $T_{RANDOM}$ for each period T of the input signal. The PLL receives the input signal from the oscillator 210 and outputs signal $f_{PWM}$ having a frequency of $2^n$ times of oscillator frequency (for an n-bit circuit 200).

Based on these signals from the sync registers 204, generator 206, and PLL 208, the state machine 202 provides an actuation signal $L_{ON}$ to a backlight LED. To generate this actuation signal $L_{ON}$, though, the state machine 202 performs several internal operations. Preferably, the state machine 202 determines whether the actuation period is approximately equal to zero or equal to the length of the period T. If the actuation period $T_{ON}$ is approximately equal to zero then the LED is not actuated for an entire corresponding period, and if the actuation period is approximately equal to the predetermined length of the period T, then the LED is actuated for an entire corresponding period. Otherwise, the state machine 202 preferably adds the actuation period $T_{ON}$ to the phase delay $T_{RANDOM}$ for each period T of the input signal. This sum is then compared to the predetermined length of the period T of the input signal. Thus, the state machine 202 generates on-times and off-times for the LED (embedded within the actuation signal $L_{ON}$) for each period T of the input signal under three separate conditional states, which are as follows: (1) the sum is less than the predetermined length of the period T; (2) the sum is greater than the predetermined length of the period T; and (3) the sum is approximately equal to the predetermined length of the period T.

Under the first conditional state, there is a one turn-on (or rising edge) and one turn-off (or falling edge) for the corresponding phase delay $T_{RANDOM}$. Preferably, if the sum is less than the predetermined length of the period T, the turn-on or rising edge occurs after the lapse of the corresponding phase delay $T_{RANDOM}$ after the beginning of the corresponding period. Additionally, the turn-off or falling edge preferably occurs after the lapse of the actuation period after the turn-on. Alternatively, this condition can be written as follows:

$$\left.\begin{aligned} t_{ON} &= T + T_{RANDOM} \\ t_{OFF} &= T + T_{RANDOM} + T_{ON} \end{aligned}\right\} \forall\, T_{ON} + T_{RANDOM} < T \tag{1}$$

Figure 3:
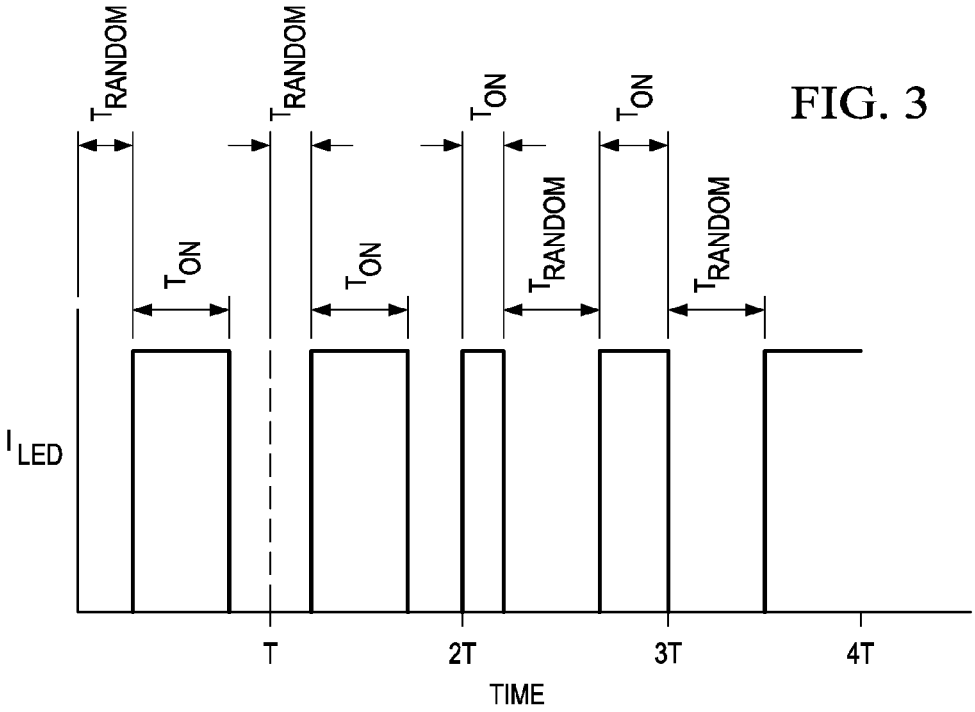
FIG. 3 is a timing diagram depicting the operation of the circuit of FIG. 2.

Some examples for the first conditional state can be seen for period 0 (between 0 and T) and for period 1 (between T and 2T) of FIG. 3.

Under the second conditional state, there are two turn-ons (or rising edges) and one turn-off (or falling edge) for the corresponding phase delay $T_{RANDOM}$. Preferably, if the sum is greater than the predetermined length of the period T, the turn-ons or rising edges occur at the beginning of the period and after the lapse of the corresponding phase delay $T_{RANDOM}$ after the beginning of the corresponding period or $T+T_{RANDOM}$. Additionally, the turn-off or falling edge preferably occurs after the lapse of the actuation period and the corresponding phase delay $T_{RANDOM}$ after the beginning of the previous period. Alternatively, this condition can be written as follows:

$$\left.\begin{aligned} t_{ON} &= T \\ t_{OFF} &= T_{n-1} + T_{RANDOM} + T_{ON} \\ t_{ON} &= T + T_{RANDOM} \end{aligned}\right\} \forall\, T_{ON} + T_{RANDOM} > T \tag{2}$$

Moreover, the sum of the length of each of these two ON periods for the second conditional state are generally equal to the actuation period $T_{ON}$. An example for the second conditional state can be seen for period 2 (between 2T and 3T) of FIG. 3.

Under the third conditional state, there is one turn-on (or rising edge) and one turn-off (or falling edge) for the corresponding phase delay $T_{RANDOM}$. Preferably, if the sum is approximately equal to the predetermined length of the period T, the turn-on or rising edge occurs after the lapse of the corresponding phase delay $T_{RANDOM}$ after the beginning of the corresponding period or $T+T_{RANDOM}$. Additionally, the turn-off or falling edge preferably occurs after the lapse of the actuation period after the turn-on or $T+T_{RANDOM}+T_{ON}$. Alternatively, this condition can be written as follows:

$$\left.\begin{aligned} t_{ON} &= T + T_{RANDOM} \\ t_{OFF} &= T + T_{RANDOM} + T_{ON} \end{aligned}\right\} \forall\, T_{ON} + T_{RANDOM} = T \tag{3}$$

An example for the third conditional state can be seen for period 3 (between 3T and 4T) of FIG. 3.

Thus, the pseudo-random phase shift and time averaging of circuit 200 should allow for a generally uniform brightness across a liquid crystal display (LCD), even with parasitic effects associated with the LCD.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. A method for generating an actuation signal for a light source, the method comprising:

generating a phase delay for each period of an input signal, wherein each period is a predetermined length;

adding each phase delay to a predetermined actuation period to generate a sum;

comparing the sum to the predetermined length;

calculating at least one turn-on and at least one turn-off for each period of the input signal from the comparison of the sum to the predetermined length; and generating the actuation signal having each turn-on and each turn-off.

2. The method of claim 1, wherein the step of comparing further comprises the step of determining whether the sum is greater than, less than, or approximately equal to the predetermined length.

3. The method of claim 2, wherein the step of calculating further comprises the step of determining the turn-on for each period having its sum being less than the predetermined length to be at its corresponding phase delay after the beginning of its corresponding period.

4. The method of claim 2, wherein the step of calculating further comprises the step of determining the turn-off for each period having its sum being less than the predetermined length to be at its corresponding phase delay plus the actuation period after the beginning of its corresponding period.

5. The method of claim 2, wherein the step of calculating further comprises the step of determining the turn-on for each period having its sum being greater than the predetermined length to be at the beginning of the period and to be at its corresponding phase delay after the beginning of its corresponding period.

6. The method of claim 2, wherein the step of calculating further comprises the step of determining the turn-off for each period having its sum being greater than the predetermined length to be at its corresponding phase delay plus the actuation period after the beginning of the previous period.

7. The method of claim 2, wherein the step of calculating further comprises the step of determining the turn-on for each period having its sum being approximately equal to the predetermined length to be at its corresponding phase delay after the beginning of its corresponding period.

8. The method of claim 2, wherein the step of calculating further comprises the step of the turn-off for each period having its sum being approximately equal to the predetermined length to be at the beginning of its corresponding period.

9. An apparatus for generating an actuation signal for a light source, the apparatus comprising:

means for generating a phase delay for each period of an input signal, wherein each period is a predetermined length;

means for adding each phase delay to a predetermined actuation period to generate a sum;

means for comparing the sum to the predetermined length;

means for calculating at least one turn-on and at least one turn-off for each period of the input signal from the comparison of the sum to the predetermined length; and means for generating the actuation signal having each turn-on and each turn-off.

10. The apparatus of claim 9, wherein the means for comparing further comprises means for determining whether the sum is greater than, less than, or approximately equal to the predetermined length.

11. The apparatus of claim 10, wherein the means for calculating further comprises means for determining the turn-on for each period having its sum being less than the predetermined length to be at its corresponding phase delay after the beginning of its corresponding period.

12. The apparatus of claim 10, wherein the means for calculating further comprises means for determining the turn-off for each period having its sum being less than the predetermined length to be at its corresponding phase delay plus the actuation period after the beginning of its corresponding period.

13. The apparatus of claim 10, wherein the means for calculating further comprises means for determining the turn-on for each period having its sum being greater than the predetermined length to be at the beginning of the period and to be at its corresponding phase delay after the beginning of its corresponding period.

14. The apparatus of claim 10, wherein the means for calculating further comprises means for determining the turn-off for each period having its sum being greater than the predetermined length to be at its corresponding phase delay plus the actuation period after the beginning of the previous period.

15. The apparatus of claim 10, wherein the means for calculating further comprises means for determining the turn-on for each period having its sum being approximately equal to the predetermined length to be at its corresponding phase delay after the beginning of its corresponding period.

16. The apparatus of claim 10, wherein the means for calculating further comprises means for determining the turn-off for each period having its sum being approximately equal to the predetermined length to be at the beginning of its corresponding period.

17. An apparatus for generating an actuation signal for a light source, the apparatus comprising:

a generator that receives an input signal having a plurality of periods with a predetermined length and that generates a phase delay for each period of the input signal; and a state machine that:

receives each phase delay and a predetermined actuation period;

adds each phase delay to the predetermined actuation period to generate a sum;

compares the sum to the predetermined length;

calculates an on-time and an off-time for each period of the input signal from the comparison of the sum to the predetermined length; and generates the actuation signal having each on-time and each off-time.

18. The apparatus of claim 17, wherein the apparatus further comprises a sync register that outputs the actuation signal to the state machine.

19. The apparatus of claim 17, wherein the apparatus further comprises a phase lock loop that generates a pulse width modulated (PWM) signal from the input signal and that outputs the PWM signal to the state machine.

20. The apparatus of claim 17, wherein the state machine generates the actuation signal having the turn-on for each period having its sum being less than the predetermined length to be at its corresponding phase delay after the beginning of its corresponding period.

21. The apparatus of claim 17, wherein the state machine generates the actuation signal having the turn-off for each period having its sum being less than the predetermined length to be at its corresponding phase delay plus the actuation period after the beginning of its corresponding period.

22. The apparatus of claim 17, wherein the state machine generates the actuation signal having the turn-on for each period having its sum being greater than the predetermined length to be at the beginning of the period and to be at its corresponding phase delay after the beginning of its corresponding period.

23. The apparatus of claim 17, wherein the state machine generates the actuation signal having the turn-off for each period having its sum being greater than the predetermined length to be at its corresponding phase delay plus the actuation period after the beginning of the previous period.

24. The apparatus of claim 17, wherein the state machine generates the actuation signal having the turn-on for each period having its sum being approximately equal to the predetermined length to be at its corresponding phase delay after the beginning of its corresponding period.

25. The apparatus of claim 17, wherein the state machine generates the actuation signal having the turn-off for each period having its sum being approximately equal to the predetermined length to be at the beginning of its corresponding period.

* * * * *